US005127751A

United States Patent [19]

Kobayashi et al.

[11] Patent Number: 5,127,751

[45] Date of Patent: Jul. 7, 1992

[54] PRINTING APPARATUS WITH IMPROVED WORK OF INK RIBBON REPLACEMENT

[75] Inventors: Akinori Kobayashi; Yutaka Nakamura; Hiroyuki Shigematsu, all of Yamatokouriyama, Japan

[73] Assignee: Sharp Kabushiki Kaisha, Osaka, Japan

[21] Appl. No.: 619,260

[22] Filed: Nov. 28, 1990

[30] Foreign Application Priority Data

Nov. 30, 1989 [JP] Japan ..... 1-312719
Nov. 30, 1989 [JP] Japan ..... 1-312720

[51] Int. Cl.[5] ..... B41J 33/32

[52] U.S. Cl. ..... 400/249; 400/229; 400/231

[58] Field of Search ..... 400/249, 206, 207, 208, 400/196.1, 219, 219.1, 229, 231, 237, 238, 315, 319, 320, 322, 50, 52

[56] References Cited

U.S. PATENT DOCUMENTS

| | | | |
|---|---|---|---|
| 4,598,301 | 7/1986 | Suzaki et al. | 400/208 |
| 4,652,154 | 3/1987 | Horiya et al. | 400/249 |
| 4,798,489 | 1/1989 | Shiota | 400/216.1 |
| 4,921,363 | 5/1990 | Nishihara et al. | 400/249 |

FOREIGN PATENT DOCUMENTS

| | | | |
|---|---|---|---|
| 0059886 | 4/1983 | Japan | 400/249 |
| 0120488 | 7/1984 | Japan | 400/249 |
| 0162078 | 9/1984 | Japan | 400/249 |
| 0101075 | 6/1985 | Japan | 400/249 |
| 0210489 | 10/1985 | Japan | 400/249 |
| 61-182961 | 8/1986 | Japan . | |
| 59-215888 | 12/1988 | Japan . | |
| 1-232073 | 9/1989 | Japan . | |

*Primary Examiner*—Eugene H. Eickholt
*Attorney, Agent, or Firm*—David G. Conlin; Robert F. O'Connell

[57] ABSTRACT

A printing apparatus in accordance with the present invention includes: a plurality of replaceable ink ribbons each having a ribbon end indicating an end of the ribbon; a printer for printing an image by using the ink ribbons while scanning printing paper; a detector for detecting any ribbon end of the ink ribbons; a stop device responsive to a detection output of the detector for stopping operation of the printer; a storage device for storing a stop position of the stopped printer; an instructing device for instructing restart of printing after replacement of the ink ribbon having the detected ribbon end with another ink ribbon; and a control device responsive to an instruction output of the instructing device for controlling the printer to restart printing by using the replaced ink ribbon based on the stored stop position.

5 Claims, 13 Drawing Sheets

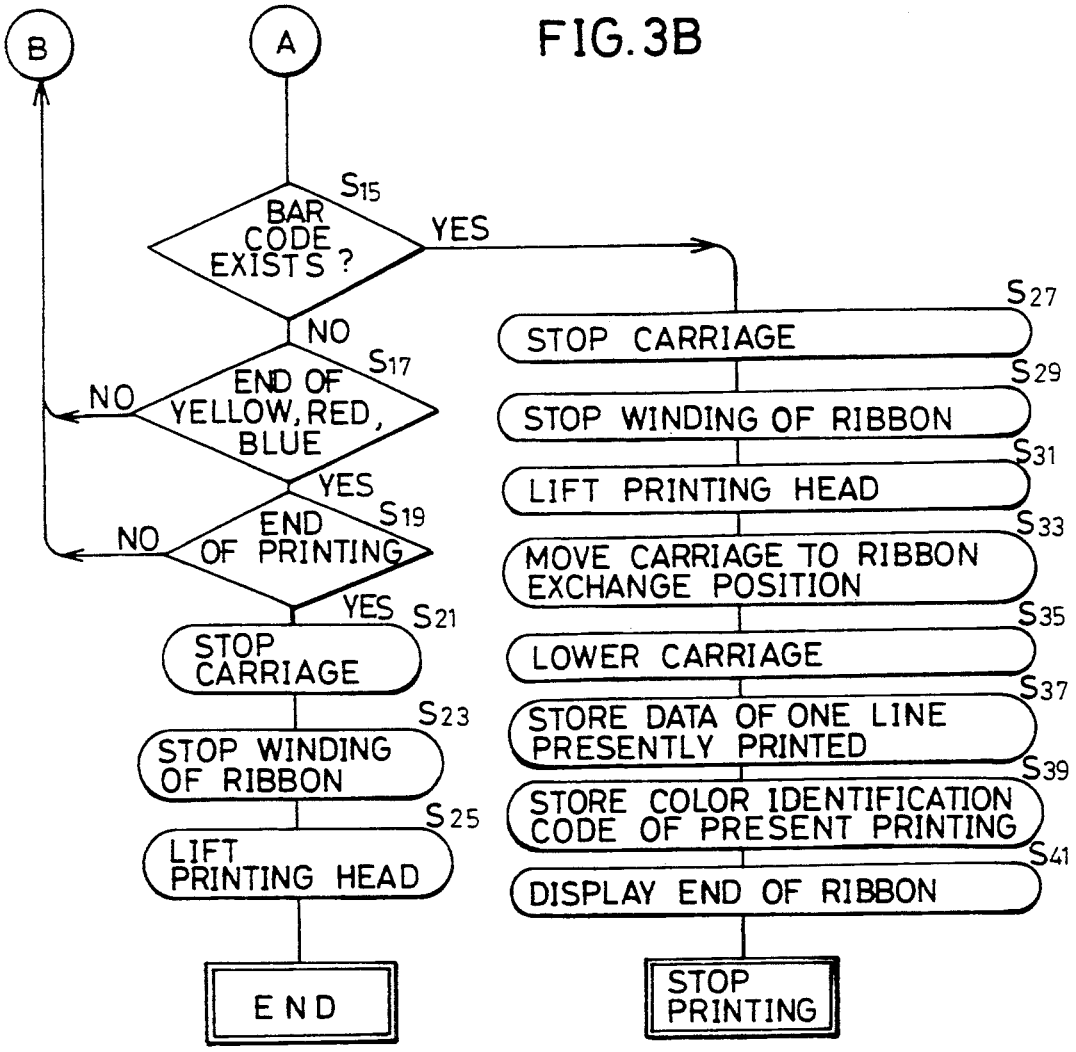
B
A
FIG. 3B
S15
BAR CODE EXISTS ?
YES
NO
S17
END OF YELLOW, RED, BLUE
NO
YES
S19
END OF PRINTING
NO
YES
S21
STOP CARRIAGE
S23
STOP WINDING OF RIBBON
S25
LIFT PRINTING HEAD
END
S27
STOP CARRIAGE
S29
STOP WINDING OF RIBBON
S31
LIFT PRINTING HEAD
S33
MOVE CARRIAGE TO RIBBON EXCHANGE POSITION
S35
LOWER CARRIAGE
S37
STORE DATA OF ONE LINE PRESENTLY PRINTED
S39
STORE COLOR IDENTIFICATION CODE OF PRESENT PRINTING
S41
DISPLAY END OF RIBBON
STOP PRINTING

PRINTING APPARATUS WITH IMPROVED WORK OF INK RIBBON REPLACEMENT

BACKGROUND OF THE INVENTION

1. Field of the Invention

The present invention relates to printing apparatus and particularly to a thermal transfer printing apparatus which can perform multicolor printing and the like.

2. Description of the Background Art

A conventional multicolor thermal transfer printing apparatus includes: a carriage which is provided with a printing head and reciprocates in scanning directions; a cassette stand which is placed over the carriage and where a plurality of ink ribbon cassettes are stacked; and a lifting device which moves the cassette stand upward or downward with respect to the carriage to select a desired ink ribbon among the plurality of ink ribbon cassettes to be opposite to a printing head during plural times of scanning operations of the printing head.

By moving the cassette stand upward and downward, it is possible to locate the desired ink ribbon opposite to the printing head so that printing can be made on printing paper. In this case, if ink ribbons of three colors of yellow, magenta, and cyan are used for the plurality of ink ribbon cassettes subtractive color mixing of those three primary colors is made in the same areas of the printing paper and thus eight colors of blue, cyan, green, yellow, red, magenta, and white (the paper's color) are obtained. Thus, a multicolor image is printed.

In the above-mentioned background art, if the ribbon in an arbitrary stage comes to an end, no means is provided to detect it. Consequently, the printing head is continuously conducted and printing continues, which sometimes makes it impossible to print an image in a desired color.

In addition, if the user becomes aware of the end of the ribbon and stops the printing, it is necessary to return the carriage to a prescribed position for replacement of the ink ribbon with another ribbon. In consequence, troublesome operation is required if printing is to be restarted since it is necessary to manually move the carriage to the previous stop position of the ribbon after replacement of the ribbon with the new one. In addition, since this operation is manually carried out, it is difficult to effect an accurate positioning at the time of restarting the printing.

In the above-mentioned background art, it sometimes happens that the user forgot attaching a black ribbon and erroneous printing with the black ribbon occurs in color printing. In such a case, the user is not aware of the attachment of the black ribbon until start of printing. In consequence, it is necessary to change the black ribbon for a color ribbon and to start printing on new printing paper and thus the work in such a case is troublesome.

SUMMARY OF THE INVENTION

An object of the present invention is to improve reliability of printing in a printing apparatus.

Another object of the present invention is to smoothly restart printing after exchange of ink ribbons in a printing apparatus.

A further object of the present invention is to prevent erroneous attachment of ink ribbons to a printing apparatus.

A still further object of the present invention is to improve economic conditions in a printing apparatus.

A still further object of the present invention is to improve operability in a printing apparatus.

In order to accomplish the above-described objects, a printing apparatus according to an aspect of the present invention includes: a plurality of replaceable ink ribbons having a ribbon end indicating an end of the corresponding ribbon; a printer for performing printing by using the ink ribbons while scanning printing paper; a detector for detecting a ribbon end of any of the ink ribbons; a stop device for stopping operation of the printer in response to an output of the detector; a storing device for storing a stop position of the stopped printer; an instructing device for instructing restart of printing after replacement of the ink ribbon having the ribbon end detected with another ribbon; and a control device for controlling the above-mentioned printer to restart printing by using the ne ink ribbon replacing the previous ribbon based on the stored stop position.

The printing apparatus thus structured stops the operation of the printer upon detection of the ribbon end of any ink ribbon and stores the stop position, which makes it easy to restart printing.

In order to accomplish the above-described objects, a printing apparatus according to another aspect of the present invention includes: a plurality of types of replaceable ink ribbons set in prescribed positions according to the types; a printer for performing printing by using the ink ribbons while scanning printing paper; a detector for detecting the types of the ink ribbons set in the prescribed positions; a determining device for determining that a correct ink ribbon is not set in a prescribed position, based on an output of the detector; and a stop device for stopping the operation of the printer in response to an output of the determining device.

The printing apparatus thus structured stops the operation of the printer when it is determined that a correct ink ribbon is not set, and thus it is possible to improve reliability in printing and to prevent wasteful printing.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 3A and 3B are flow charts showing control procedure of the CPU in FIG. 2.

DESCRIPTION OF THE PREFERRED EMBODIMENT

Figure 1:
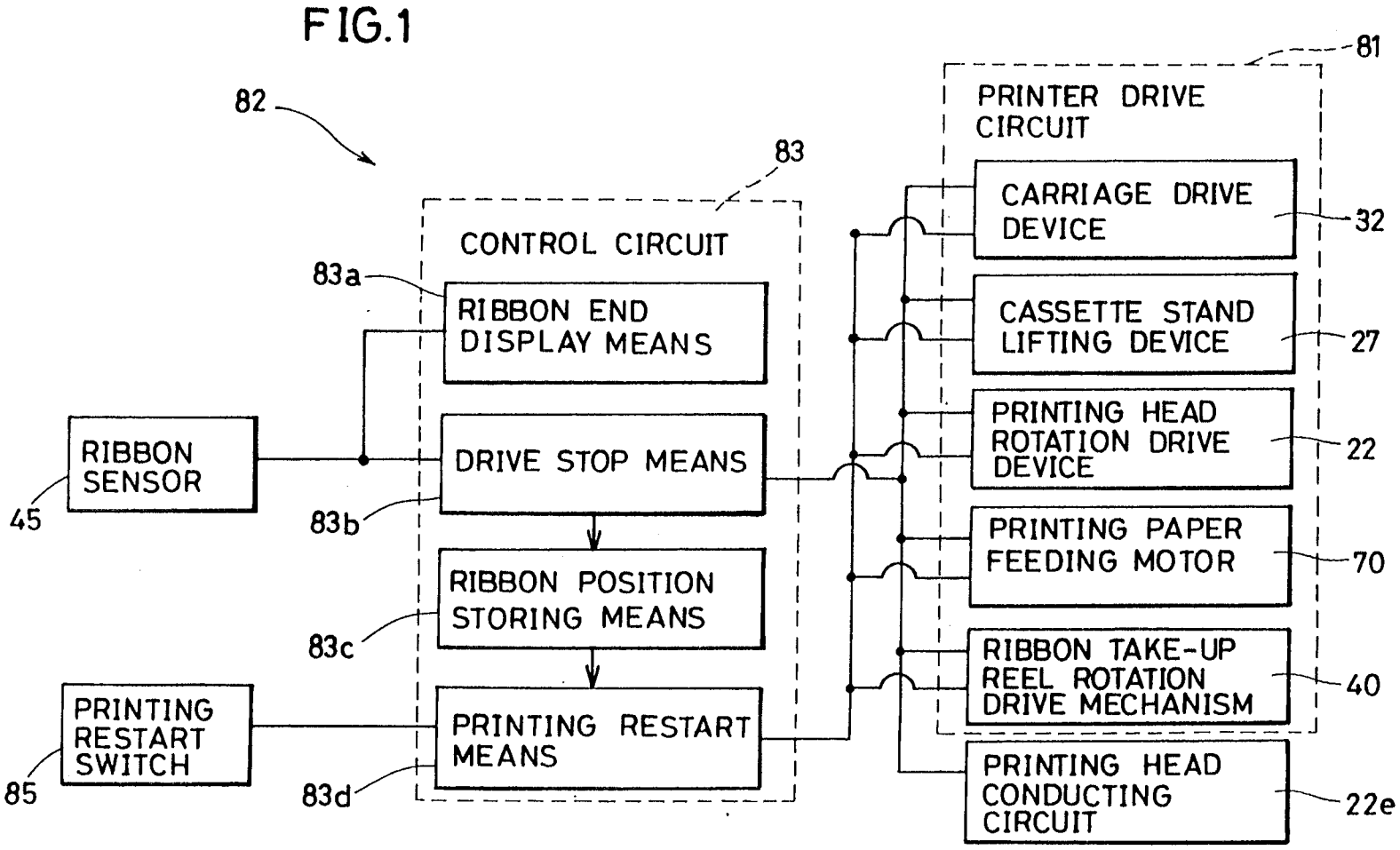
FIG. 1 is a functional block diagram of a thermal transfer printing apparatus according to a first embodiment of the present invention.

The first embodiment of the invention will be described with reference to the drawings.

As shown, a thermal transfer printing apparatus has a main body 21 including: a carriage 23 having a printing head 22 and reciprocating in scanning directions perpendicular to a paper feeding direction; a cassette stand 25 which is placed over the carriage 23 and where a plurality of ink ribbon cassettes 24 are stacked; and a lifting device 27 which moves the cassette stand 25 upward and downward with respect to the carriage 23 to successively select a desired ink ribbon 26 among the plurality of ink ribbon cassettes 24 to locate it opposite to the printing head 22 during a plural number of scanning operations by the printing head 22.

Figure 4:
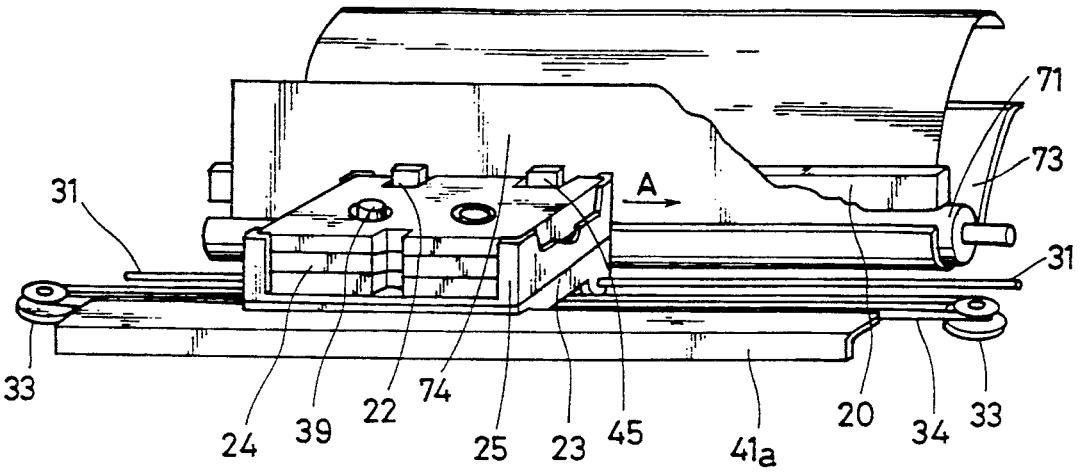
FIG. 4 is a perspective view showing attachment of cassettes in the thermal transfer printing apparatus of the first embodiment of the invention.
Figure 11:
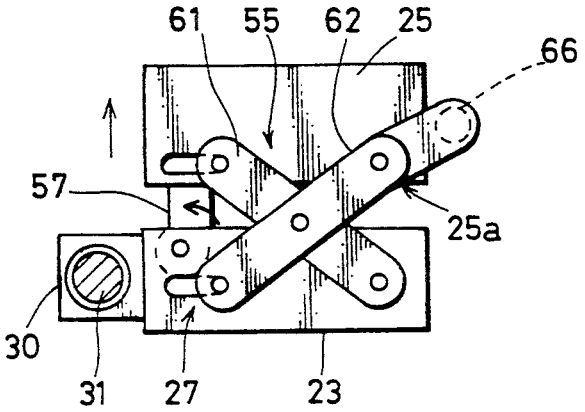
FIG. 11 is a side view of the lifting device for the cassettes in FIG. 4.

The carriage 23 is of a box type as shown in FIGS. 4, and 11, and it has a front portion 23*a* provided with a sliding hole 30 opened in the scanning directions, with a guide bar 31 of the main body 21 being engaged with the sliding hole 30.

Figure 7:
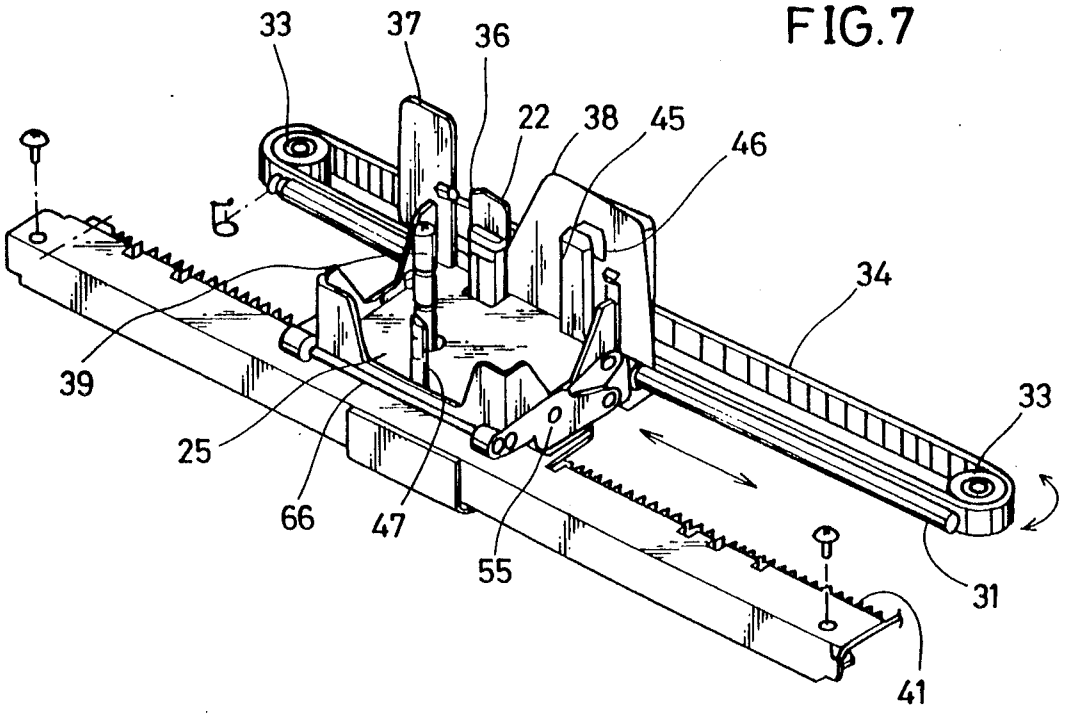
FIG. 7 is a perspective view of a scanner of the carriage in FIG. 4.
Figure 8:
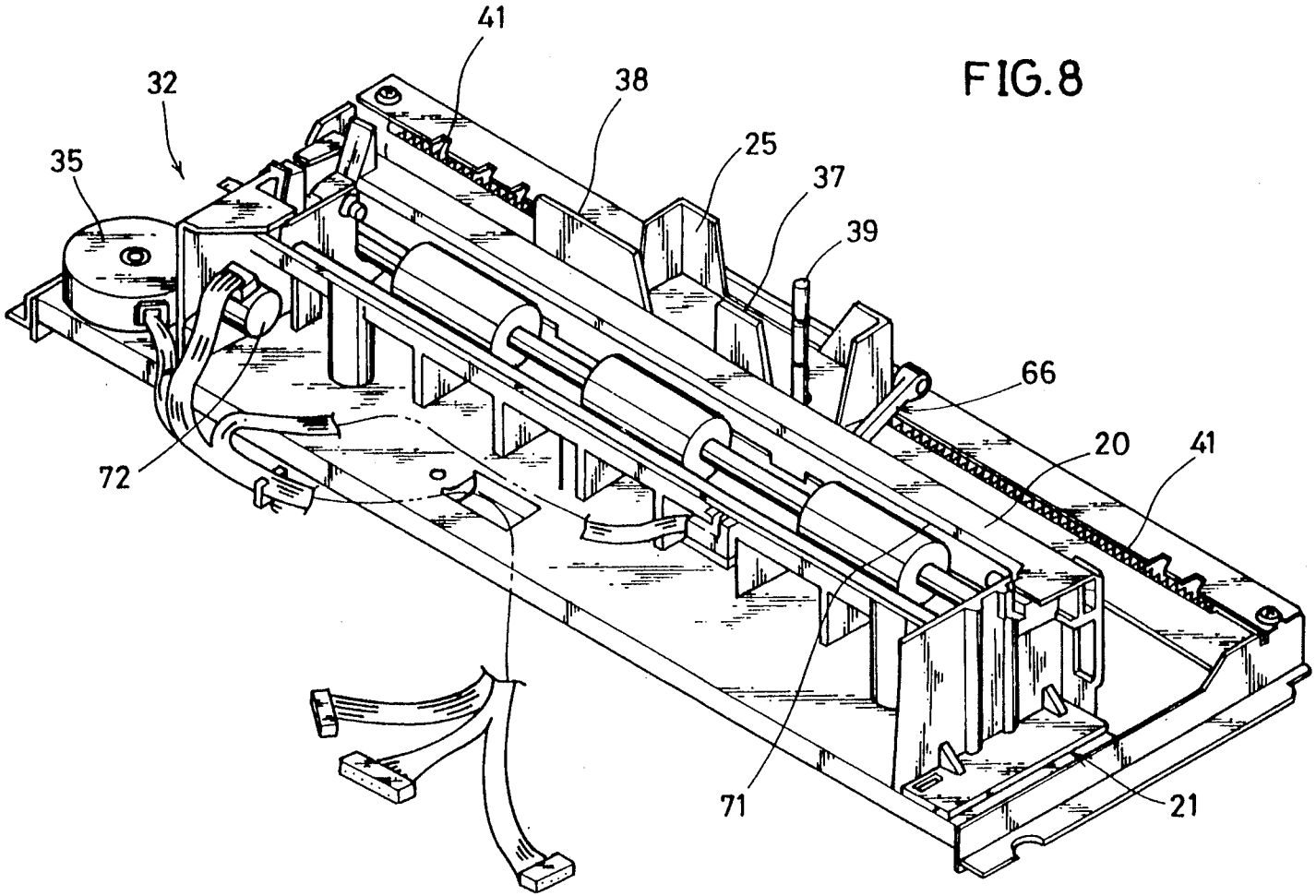
FIG. 8 is a perspective view of the thermal transfer printing apparatus according to the first embodiment of the invention.

A drive device 32 for moving the carriage 23 in the scanning directions includes: a pair of right and left pulley gears 33 provided on both ends of the scanning course shown in FIGS. 7 and 8; an endless timing belt 34 which fixes a front portion 23*a* of the carriage 23, set around the pulley gears 33; and a scanning motor 35 which drives the pulley gears 33.

Figure 9:
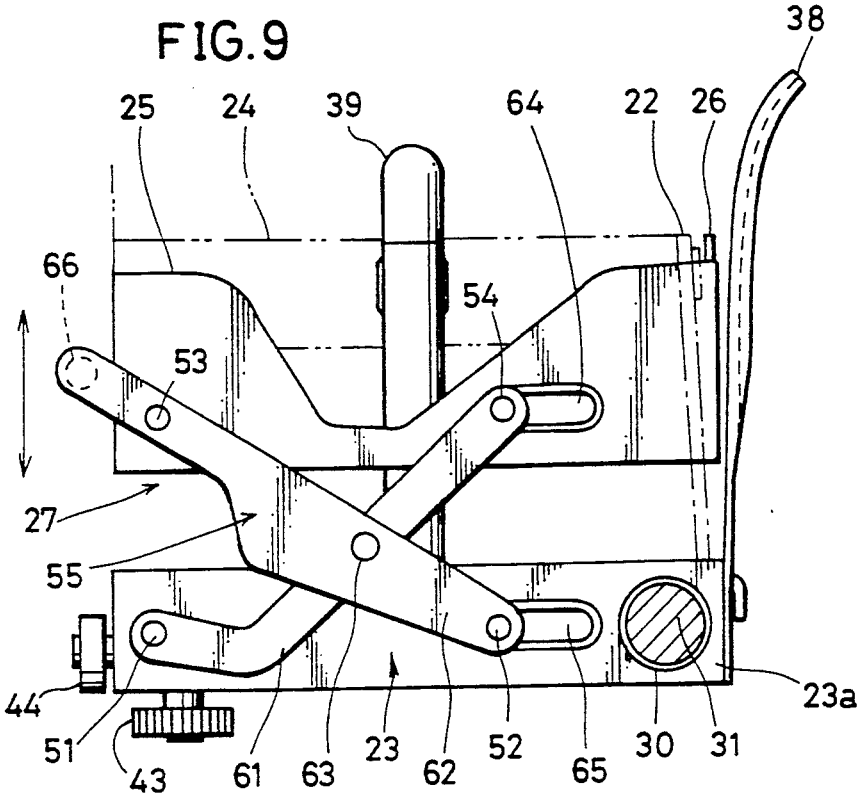
FIG. 9 is a side view of the carriage in FIG. 4.
Figure 12:
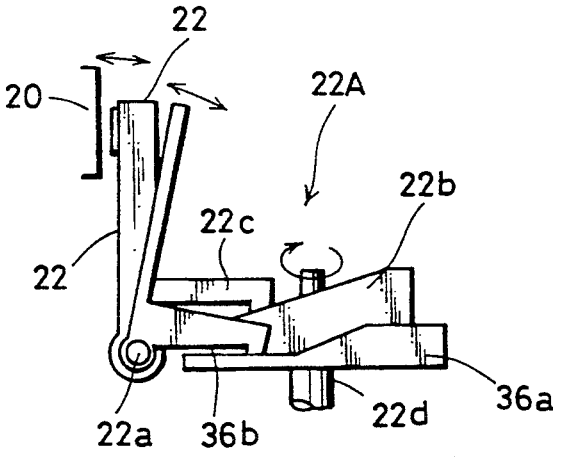
FIG. 12 shows a rotation drive device of the printing head in FIG. 4.

The printing head 22 mounted on the carriage 23 is a thermal head and, as shown in FIGS. 7, 9 and 12, it is supported in a front portion of the carriage 23 in a manner rotatable forward (toward a platen 20) around a shaft 22*a* in its lower end.

Figure 2:
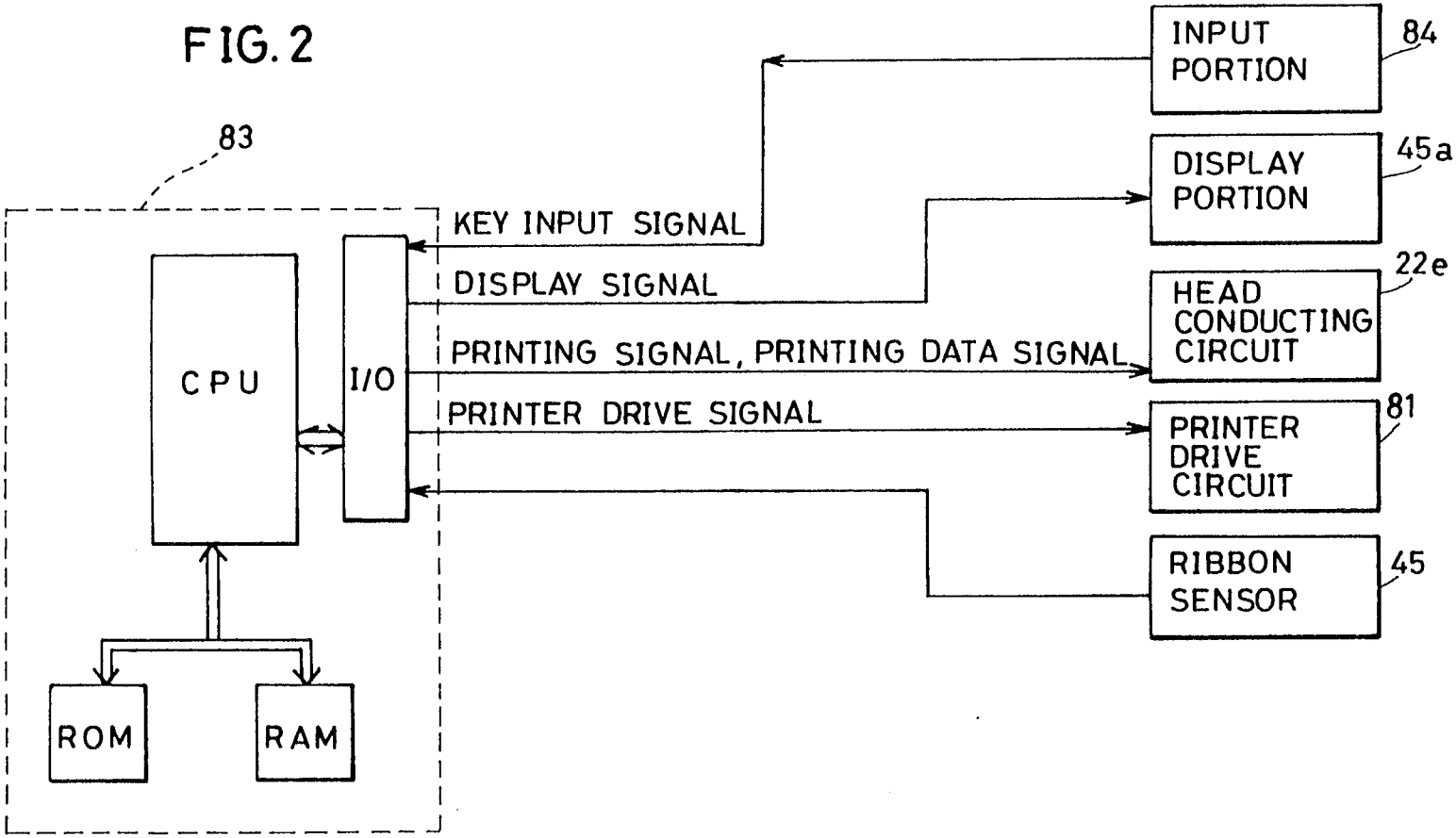
FIG. 2 is a diagram showing a circuit configuration around the control circuit in FIG. 1.

A rotation drive unit 22A of the printing head 22 includes: a head drive cam 22*b* rotating around a motor shaft 22*d* of the motor not shown; and a follower member 22*c* in contact with the cam surface of the head drive cam 22*b*. The printing head 22 is conducted by a conducting circuit 22*e* (as shown in FIGS. 1 and 2).

A detachment lever 36 is disposed near the scanning course of the printing head 22. The detachment lever 36 is supported by the carriage 23 as in the case of the printing head 22 in a manner rotatable forward (toward the platen) around the shaft 22*a* of the lower end, as shown in FIGS. 7 and 12. Drive means 36A for driving the detachment lever 36 includes: a variable cam 36*a* fixed to an outer surface of the drive cam 22*b*; and a follower member 36*b* in contact with the cam surface of the variable cam 36*a* fixed to a lower end of the detachment lever 36. The detachment lever 36 rotates to adjust a detachment angle of the ink ribbon according to a printing speed.

The carriage 23 further includes a first paper guide plate 37 and a second paper guide plate 38 which are disposed on both sides of the printing head 22 and detachment lever 36. The first paper guide plate 37 is fixed on the carriage 23 in a manner in which an upper end of the plate 37 is curved toward the platen (forward) to prevent paper after printing from bending toward the printing head 22.

The second paper guide plate 38 serves to prevent bending of paper toward the printing head 22 and to prevent an unfixed state of the paper at the time of printing. Thus, the second paper guide plate 38 is fixed on the carriage 23 in a manner in which an upper end of the plate 38 is curved toward the platen (forward) and a side end portion thereof in the printing direction is curved toward the platen (forward).

A take-up reel 39 to penetrate the cassette stand 25 is supported rotatably on the carriage 23 on the rear side of the printing head 22. A rotation drive mechanism 40 of the take-up reel 39 includes: a rack 41 disposed on the rear side of the carriage 23 along the scanning directions as shown in FIG. 7; and a pinion 43 (as shown in FIG. 9) which is engaged with the rack 41 by the rotation of the printing head 22 to rotate according to movement of the carriage 23 and to transmit the rotation force to the take-up reel 39. A roller 44 for support of the carriage shown in FIG. 9 moves slidably on a non-geared slide table 41*a* of the rack 41.

A ribbon sensor 45 is disposed in a front portion of the carriage 23. The ribbon sensor 45 detects a color ribbon, a black ribbon and a ribbon end, and it is formed by an optical coupling device. The result of detection of the ribbon sensor 45 is displayed in a display portion 45*a* by ribbon end display means 83*a*. Thus, the user can confirm matching or mismatching between a printing mode and an attached ribbon, or can be informed of an end of the ribbon.

A reflection plate 46 is attached to the second paper guide plate 38, in a position opposite to the ribbon sensor 45. The color of the ribbon is determined based on an optical signal obtained by reflection of light from the reflection plate 46 onto the ribbon sensor 45. For example, the determination as to whether the ribbon is a color ribbon or a black ribbon is made by using signals of high level (color) and low level (black) of the reflected light. The ribbon end is determined by a signal generated by a stripe pattern provided in an end of the ink ribbon 26.

Figure 10:
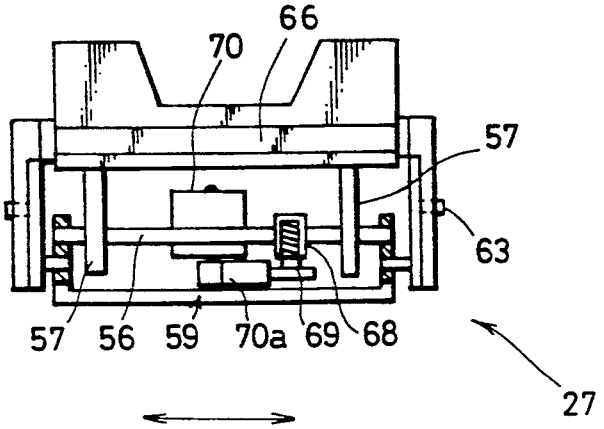
FIG. 10 is a front view of a lifting unit of the cassette portion in FIG. 4.

The ink ribbon cassette stand 25 is of a type opened on the upper side and surrounded by side walls as shown in FIGS. 9 to 11. In this embodiment, ink ribbon cassettes 24 of three different colors of yellow, red and blue are stacked on the cassette stand 25. A cassette stopper 47 shown in FIG. 7 has elasticity and prevents displacement of the ink ribbon cassettes 24.

The lifting device 27 includes, as shown in FIGS. 9, 10 and 11, a link mechanism 55 having one end coupled to the carriage 23 by means of pins 51 and 52 and the other end coupled to the cassette stand 25 by means of pins 53 and 54, cams 57 supported rotatably by the carriage 23 by means of a drive shaft 56, each having a cam surface in contact with a bottom surface 25*a* of the cassette stand 25, and a drive mechanism 59 driving the cams 57.

The link mechanism 55 is a pantograph mechanism disposed on each of the right and left sides of the cassette stand 25 and having first and second links 61 and 62 on each side coupled by a pin 63 at the center. An upper end pin 54 of the first link 61 is engaged with a lateral groove 64 of the cassette stand 25 and a lower end pin 52 of the second link 62 is engaged with a lateral groove 65 of the carriage 23. A link 66 coupling the link mechanisms 55 on both sides of the cassette stand 25 is provided on an upper end of each second link 62.

Each cam 57 has a stroke ratio of 1:1 between a cam stroke and the cassette stand 25 to be moved and, as shown in FIG. 10, it is supported by the drive shaft 56 extending to both sides of the carriage 23 and it has a shape enabling upward and downward movement of the cassette stand 25 at three stages for example.

The drive mechanism 59 for the cams 57 includes: a worm wheel 68 fixedly engaged with the drive shaft 56, a worm 69 engaged with the worm wheel 68, and a stepping motor 70 rotating the worm 69 by means of a gear mechanism 70*a*.

Referring to FIG. 8, a motor 72 rotates feed rollers 71. Referring to FIG. 4, a guide plate 73 guides printing paper 74.

The printing apparatus of this embodiment includes: a printer drive circuit 81 including a carriage drive device 32, a cassette stand running device 27, a printing head driving device 22A, a printing paper feed motor 70, a ribbon take-up reel driving mechanism 40; a printing head conducting circuit 22*e*; and a control device 82 controlling the display portion 45*a*.

The control device 82 includes: ribbon end display means 83*a* indicating a ribbon end in the display portion 45*a* in response to a ribbon end signal; drive stop means 83*b* for stopping the carriage drive device 32 in response to the ribbon end signal of the ribbon sensor 45; ribbon position storing means 83*c* for storing a stop position of the carriage drive device 32 stopped by the drive stop means 83*b*; and printing restart means 83*d* for restarting printing from the stop position stored by the ribbon position storing means 83*c* in response to a printing restart signal supplied by a printing restart switch 85 in an input portion 84 after replacement of the ink ribbon 26 with another ribbon.

Those ribbon end display means 83*a*, drive stop means 83*b*, ribbon position storing means 83*c* and printing restart means 83*d* constitute a drive circuit 83, which is formed by a general one-chip microcomputer as shown in FIG. 2, including a data RAM, a program ROM, a CPU and input/output (I/O) circuit.

The lifting device 27 is operated in response to a printing instruction and selection is made as to what color of ink ribbon is used for printing. In the operation of the lifting device 27, first, the stepping motor 70 is driven and the gear mechanism 70*a*, the worm 69 and the worm wheel 68 rotate, so that the cams 57 rotate from lowered positions to raised positions for example by the rotation of the drive shaft 56. As a result of rotation of the cams 57, the cassette stand 25 in contact therewith is lifted with at least right and left sides thereof being maintained horizontal by the link mechanisms 55.

When a desired ink ribbon cassette 24 is located in a printing position, the pulley gears 33 are rotated by the drive motor 35 to drive the timing belt 34, whereby scanning on the carriage 23 is performed. Then, the printing head 22 is heated to melt ink of the ink ribbon cassette 24, whereby the ink is thermally transferred onto the paper on the platen.

In color printing operation, printing is started at first by using a ribbon (yellow) of the upper stage. For this purpose, after the printing head 22 is pressed against the paper, the carriage 23 is moved and at the same time the printing ribbon of the upper stage in the ribbon cassette 24 is wound by means of the reel 39. Then, yellow printing data is transmitted to the printing head 22 and in response to a printing instruction, the printing head 22 is heated, whereby the yellow ink of the printing ribbon is transferred onto the printing paper.

Next, the stack of ribbon cassettes 24 is raised by one stage and printing is performed in the same manner by using the ribbon (red) in the intermediate stage.

Then, the stack of ribbon cassettes 24 is further raised by one stage and printing is performed in the same manner by using the ribbon (blue) in the lower stage.

Thus, color printing is performed by transferring yellow, red and blue inks in an overlapping manner for each line.

Figure 6:
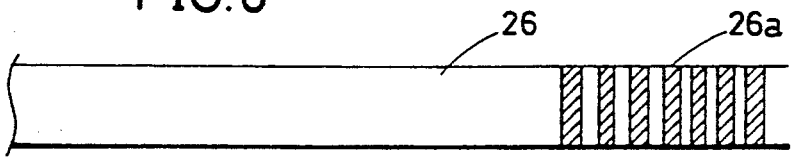
FIG. 6 is a view showing an end of an ink ribbon according to the first embodiment of the invention.

At the time of winding the printing ribbons (yellow, red, blue) by the reel 39 during printing, if a bar code portion 26*a* (as shown in FIG. 6) indicating a printing end exists, it is detected by the sensor 45. When a ribbon end signal generated by the sensor 45 during the printing is detected by a microcomputer 83, the printing operation is stopped at that position and a color code which is being printed is stored. Then, after the carriage 23 is moved to a position for exchange of ribbon cassettes 24, an indication is given to inform the user that the printing ribbon comes to an end. If the user designates continuation of printing after replacement with a new ribbon, the microcomputer detects the previously stopped position and the ribbon in the previous stage is selected by moving upward or downward the ribbon cassettes 24. Then, printing is restarted from that position.

Thus, even if a printing ribbon comes to an end during printing, the printing can be continuously performed without causing any failure in color printing.

Figure 3A:
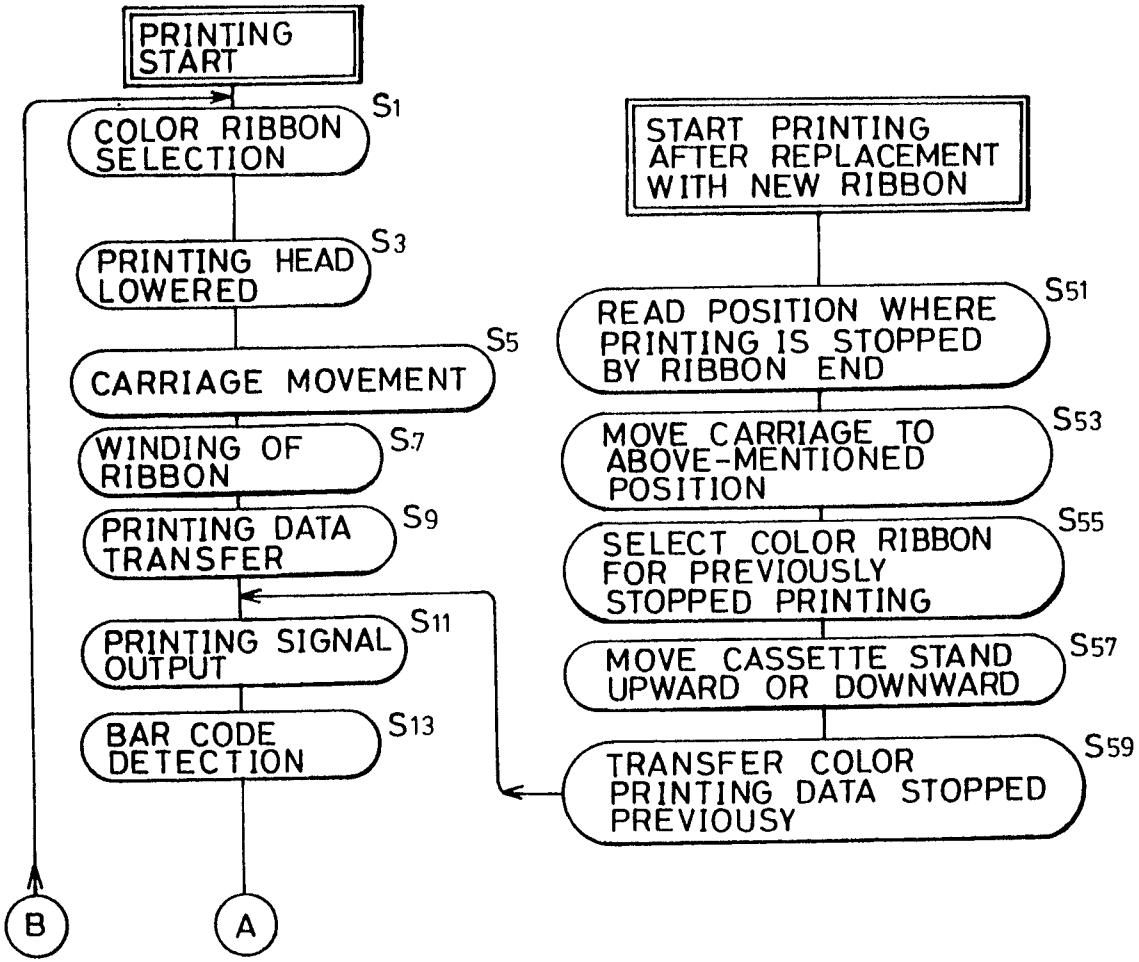

The above-mentioned control will be described in more detail with reference to the flow charts in FIGS. 3A and 3B.

Figure 5:
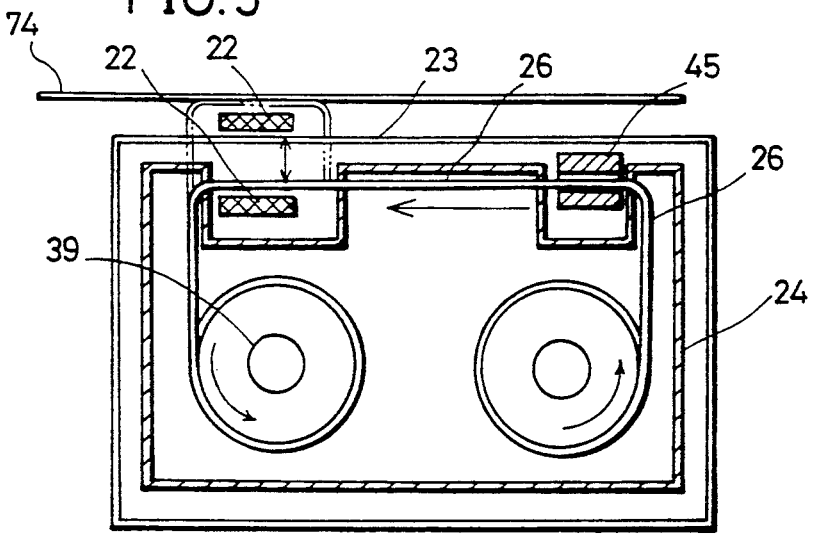
FIG. 5 is a plan view of the carriage in FIG. 4.

After start of printing, the printing head 22 is pressed against the printing paper 74 (in S1) as shown by the chain lines in FIG. 5 and the printing head 22 is moved downward (in S3). The carriage 23 is moved in the direction A (in S5) and the printing ribbon 26 is wound by the reel 39 (in S7). After a printing signal (of a yellow component) is supplied (in S11), the sensor 45 detects presence or absence of the bar code 26*a* (in S13). If a ribbon end signal is not detected by the microcomputer (NO in S15), yellow, red and blue components are printed for each line by using the ribbons in the upper, intermediate and lower stages (NO in S17) and the operation is repeated until an end of printing (NO in S19).

If the ribbon end signal is issued during printing, the movement of the carriage 23 and the winding of the ribbon are stopped (in S27 and S29) and after the printing head 22 is detached from the printing paper 74 (in S31), the carriage 23 is moved to the position for exchange of ribbons (in S33).

Since the printing is being performed, the data for one line which is being printed is stored (in S37) and a color code (representing yellow, red or blue) and the stop position of the printing are stored in the microcomputer (in S39). After that, a ribbon end indication is given to inform the user that the ribbon comes to an end (in S41).

When the user designates restart of printing after a new ribbon is set on the carriage 23, the microcomputer reads the previous stop position of printing and the type of the ribbon corresponding to the color code from the RAM (in S51) and the carriage 23 is moved to that position (in S53). In order to select an appropriate ribbon corresponding to the color code (in S55), the cassette stand 25 on the carriage 23 is moved upward or downward and after that color data from the previously stopped position is transferred to the printing head 22 (in S59), whereby a printing signal is provided and printing is restarted (in S11). This operation is repeated until an end of printing.

As is evident from the foregoing description, according to the first embodiment of the invention, even if a printing ribbon comes to an end during printing, printing can be continued without causing any failure in color printing halfway.

Next, the second embodiment will be described with reference to the drawings.

Since the first embodiment shown in FIGS. 2, 4, 5, 7, 8, 9, 10, 11 and 12 is common to the second embodiment, the description thereof is not repeated. In the following, only different features from the first embodiment will be described.

Figure 13:
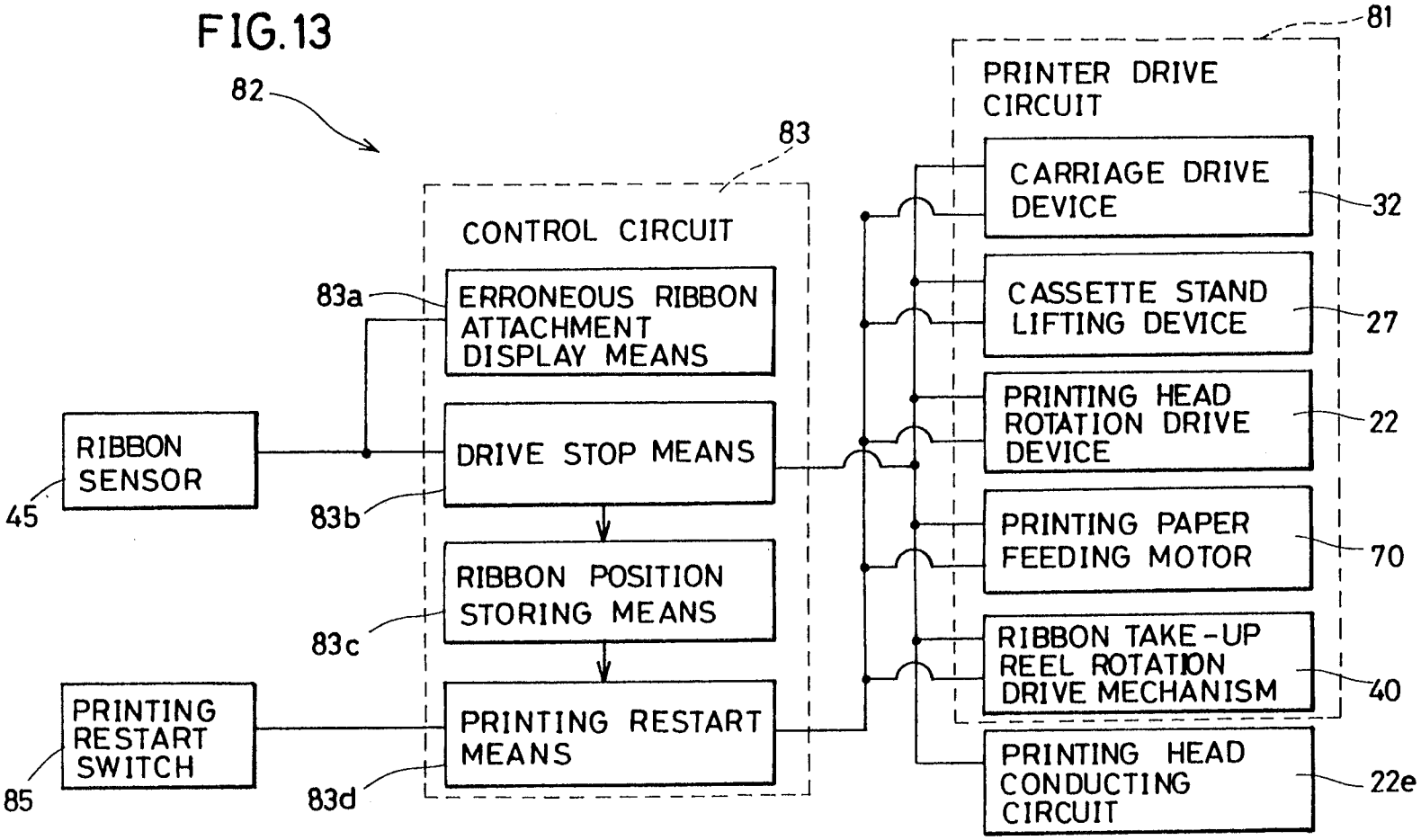
FIG. 13 is a functional block diagram of a thermal transfer printing apparatus according to another embodiment of the invention.

Referring to FIG. 13, the control device 82 includes: erroneous ribbon attachment display means 83*a* for indicating erroneous ribbon attachment in the display portion 45*a* based on the type of the ribbon (black or color); drive stop means 83*b* for stopping printing in response to an erroneous ribbon attachment signal from the ribbon sensor 45; ribbon position storing means 83*c* for storing a stop position of the cassette stand lifting device 27 stopped by the drive stop means 83*b*; and printing restart means 83*d* for restarting printing from the vertically defined position stored by the ribbon position storing means 83*c* in response to a printing restart signal provided by a printing restart switch 85 in an input portion 84 after replacement of the ink ribbon 26 by a new one.

Those erroneous ribbon attachment display means 83*a*, drive stop means 83*b*, ribbon position storing means 83*c* and printing restart means 83*d* constitute a control circuit 83, which is formed by a general one-chip microcomputer as shown in FIG. 2 of the first embodiment, and it includes a data RAM, a program ROM, a CPU, and an input/output (I/O) circuit.

Figure 15:
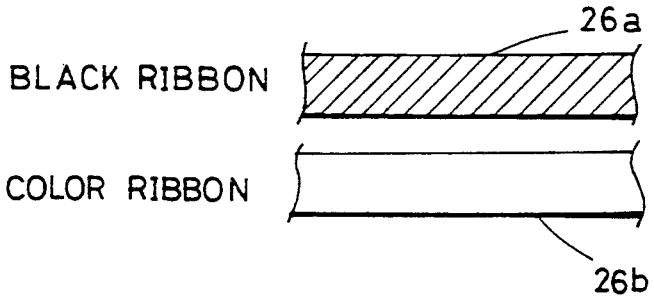
FIG. 15 is a view showing a black ribbon and a color ribbon according to the second embodiment of the invention.

A reflection plate 46 is provided in the second paper guide plate 38 in a position opposite to the ribbon sensor 45. An optical signal generated by reflection of light from the reflection plate 46 to the ribbon sensor 45 is used for determination as to the ribbon. Fcr example, it is determined whether the ribbon is a color ribbon or a black ribbon, in response to signals of high level (color) and low level (black) of the reflected light because the color ribbon 26*b* is transparent and the black ribbon 26*a* is not transparent as shown in FIG. 15.

At the time of winding the printing ribbon by the reel 39 during printing, the output of the sensor 45 at low level if a black ribbon is not attached or the output at high level if a color ribbon is not attached is supplied to the microcomputer, which determines the level. Thus, it is determined whether the attached ribbon is a color ribbon or a black ribbon.

At the time of color printing using a ribbon in a arbitrary stage (color printing is to be performed by using successively the yellow ribbon in the upper stage, the red ribbon in the intermediate stage and the blue ribbon in the lower stage), it is determined before start of printing with the ribbon in that arbitrary stage whether the attached ribbon in that stage is a black ribbon or not. If the black ribbon is attached, printing is stopped and an indication is made to inform the user that the different ribbon is attached.

When the user replaces it with a correct color ribbon and instructs printing, correct printing is restarted by using the color ribbon in the stage for which printing is to be made.

Thus, even if the user erroneously attaches the black ribbon, color printing can be performed normally.

Figure 14A:
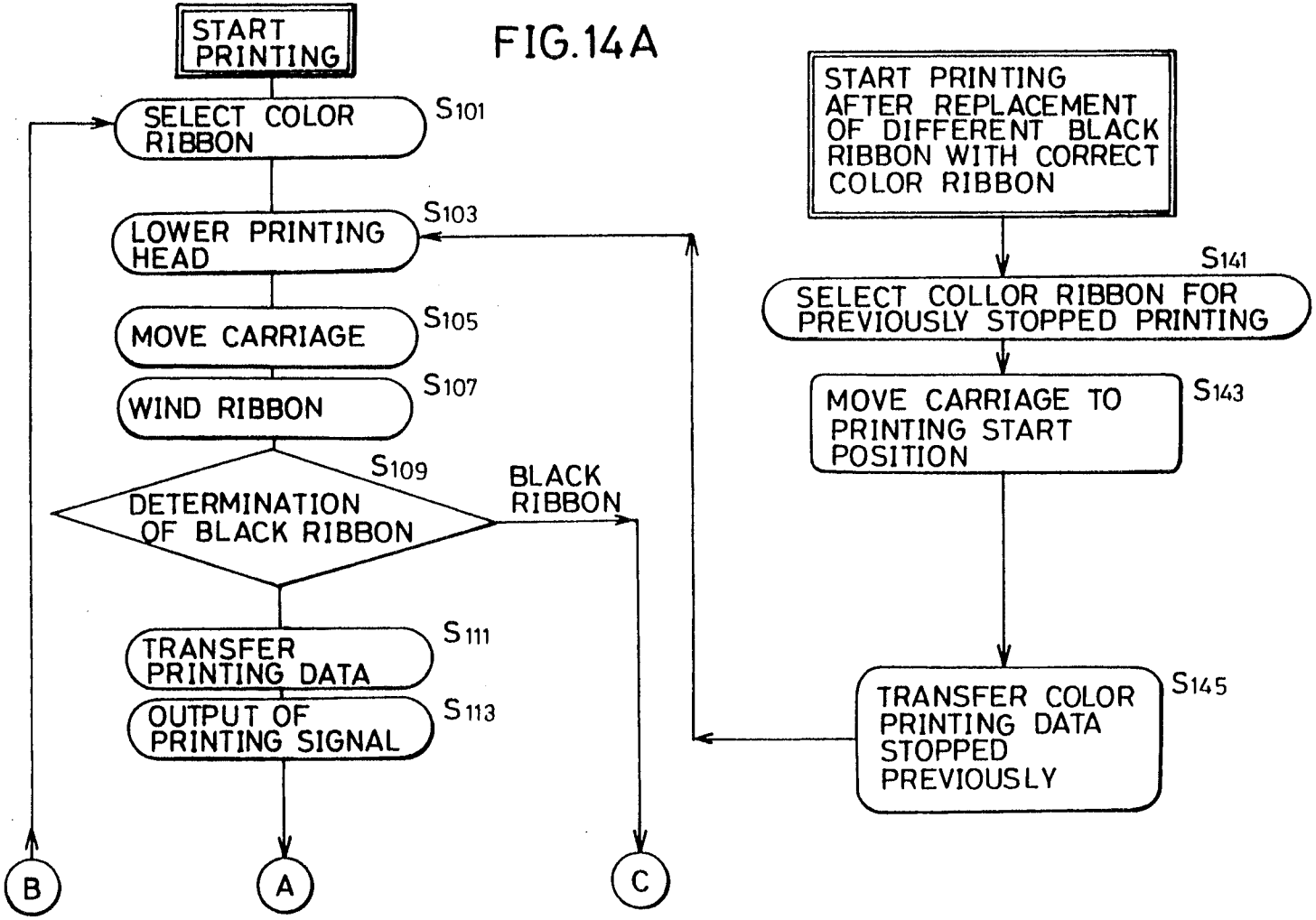
FIGS. 14A and 14B are flow charts showing control procedure of a CPU according to the above-mentioned second embodiment of the invention.
Figure 14B:
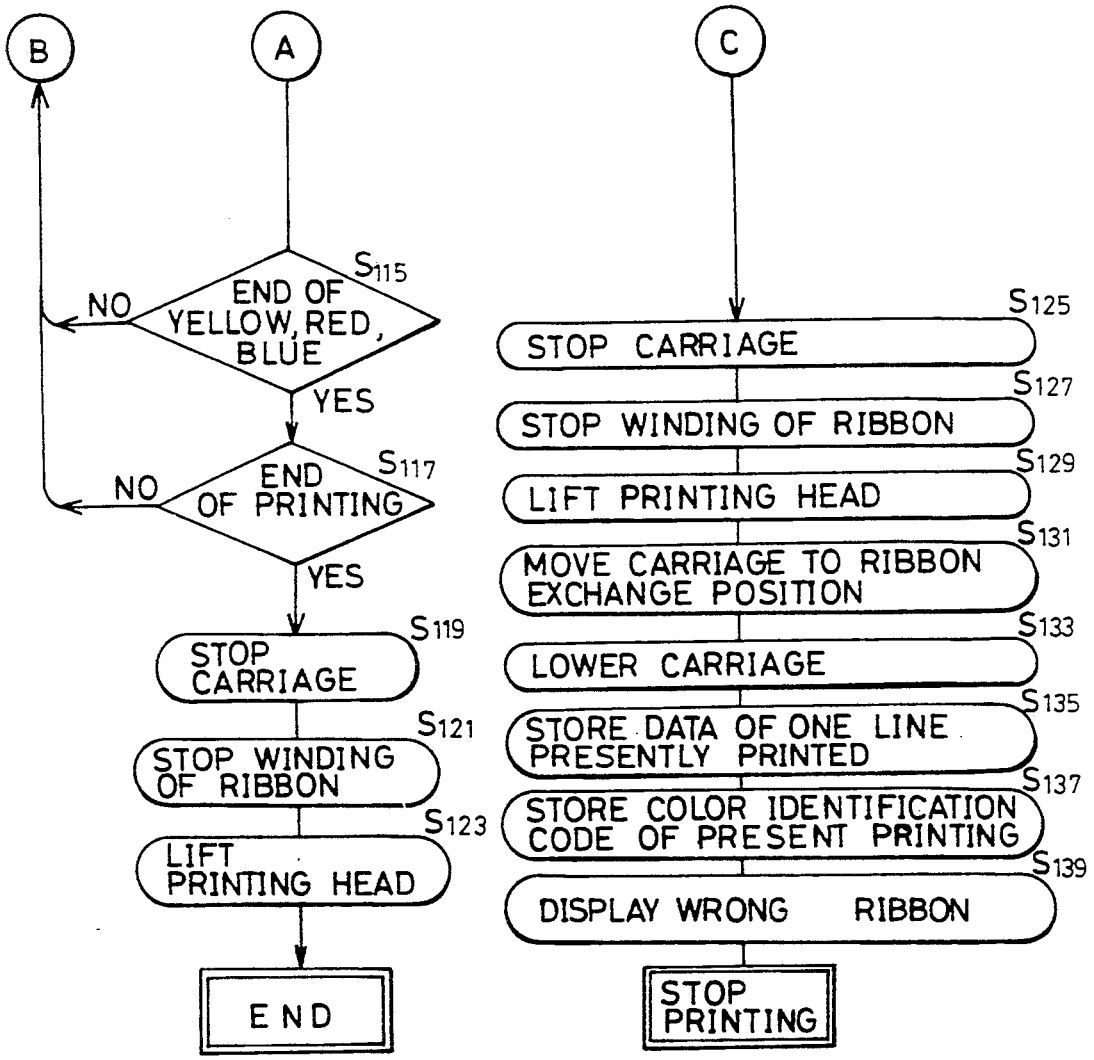

The control procedure will be described in detail with reference to the flow charts in FIGS. 14A and 14B.

After start of printing, a color ribbon is selected (in S101) and the printing head 22 is pressed against the printing paper 74 (in S103). The carriage 23 is moved in the direction A shown in FIG. 4 related with the first embodiment (in S105) and the printing ribbon 26 is wound by means of the reel 39 (in S107). At the time of starting the motor before printing, a level is detected by the sensor 45 based on transmittivity of the ribbon, whereby it is determined that the attached ribbon in the ribbon cassette is a black ribbon or a color ribbon (in S109).

If the black ribbon is attached, the output of the sensor 45 is at low level. Consequently, printing operation is stopped before starting color printing (in S125, S127, S129) and the carriage 23 is moved to the position for exchange of ribbons (in S131), where the stack of ribbon cassettes is moved downward (in S133).

At this time, the color code to be used for color printing and the printing data are stored in the microcomputer (in S135, S137). At the same time, the display portion 45*a* turns on to inform the user that a different ribbon is attached (in S139).

When the user newly designates start of printing after replacement with a new ribbon in the carriage 23, the microcomputer reads the color data before the stop of printing and the type of the ribbon corresponding to the color code. After that, in order to select a correct ribbon corresponding to the color code (in S141), the microcomputer moves upward or downward the cassette stand 25 on the carriage 23 and moves the carriage 23 to the printing start position to restart printing operation (in S143). Thus, the color data is transmitted to the printing head 22 (in S145) and a printing signal is provided, whereby printing is performed. This operation is repeated until an end of printing (in S111 to S123).

As is clearly understood from the foregoing description, according to the second embodiment of the invention, when a black ribbon is determined to be attached during color printing, the printing is stopped and the stop is displayed. Consequently, it is possible to prevent erroneous printing even if the black ribbon is erroneously attached by the user.

Although the present invention has been described and illustrated in detail, it is clearly understood that the same is by way of illustration and example only and is not to be taken by way of limitation, the spirit and scope of the present invention being limited only by the terms of the appended claims.

We claim:

1. A printing apparatus comprising:

a plurality of replaceable ink ribbons of different kinds, each said ink ribbon having a ribbon end indicating an end of the ribbon;

printing means for performing printing using one of said ink ribbons while scanning printing paper;

detecting means for detecting any ribbon end of said ink ribbons and the kind of ink ribbon the ribbon end of which has been detected;

stop means for stopping operation of said printing means in response to an output of said detecting means;

storing means for storing a stop position of said printing means and information on said detected kind of ink ribbon;

instructing means for instructing a restart of printing after replacement of the ink ribbon having the detected ribbon end with another replacement ink ribbon; and control means responsive to an instruction output of said instructing means for controlling said printing means to restart printing using said replacement ink ribbon based on said stored stop position and said stored information on said detected kind of ink ribbon.

2. The printing apparatus in accordance with claim 1, wherein said printing means includes: a carriage which is provided with said ink ribbons detachably and on which a printing head is mounted; a carriage drive device which moves said carriage in scanning directions perpendicular to a feeding direction of the printing paper; and a ribbon take-up drive mechanism for winding said ink ribbons during printing.

3. The printing apparatus in accordance with claim 2, wherein said storing means stores a stop position of said carriage drive device.

4. The printing apparatus in accordance with claim 3, wherein said printing apparatus is a thermal transfer printing apparatus.

5. The printing apparatus in accordance with claim 4, wherein said ink ribbons include ink ribbons of three colors of yellow, magenta and cyan, and said printing means prints a multicolor image by subtractive color mixing in overlapping areas on the printing paper by using the ink ribbons of the three colors.

* * * * *